United States Patent [19]

Bond

[11] Patent Number: 4,514,904

[45] Date of Patent: May 7, 1985

[54] RAZOR HANDLE

[75] Inventor: Michael J. Bond, Quincy, Mass.

[73] Assignee: The Gillette Company, Boston, Mass.

[21] Appl. No.: 534,240

[22] Filed: Sep. 21, 1983

[51] Int. Cl.[3] ..... B26B 21/52

[52] U.S. Cl. ..... 30/87; 30/47

[58] Field of Search ..... 30/47, 87, 89, 57, 85

[56] References Cited

U.S. PATENT DOCUMENTS

| | | | |
|---|---|---|---|
| 4,026,016 | 5/1977 | Nissen | 30/87 X |
| 4,057,896 | 11/1977 | Trotta | 30/87 |
| 4,083,104 | 4/1978 | Nissen et al. | 30/47 |
| 4,198,746 | 4/1980 | Trotta | 30/89 X |
| 4,253,237 | 3/1981 | Jacobson | 30/89 |
| 4,266,340 | 5/1981 | Bowman | 30/89 |
| 4,281,455 | 8/1981 | Dixon | 30/89 |
| 4,475,286 | 10/1984 | Saito | 30/85 X |

*Primary Examiner*—Jimmy C. Peters

*Attorney, Agent, or Firm*—Raymond J. De Vellis

[57] ABSTRACT

A razor handle for a removable pivoting razor blade assembly. The razor blade assembly includes cam means for receiving a biasing force and journal bearing means. The razor handle includes movable members having attached journals, which are slidably movable toward and away from each other to permit engagement of the journal bearing means of the razor blade assembly with the journals of the razor handle. The razor handle also includes cam follower means to provide a yieldable biasing force on the cam means of the razor blade assembly and to maintain the movable members in a latched position until the razor blade assembly provides a predetermined force to the cam follower means to release the movable members to an unlatched position in engagement with the razor blade assembly.

11 Claims, 7 Drawing Figures

RAZOR HANDLE

BACKGROUND OF THE INVENTION

This invention relates to wet shaving systems and more particularly to a razor handle which is releasably attachable to a razor blade assembly. The razor blade assembly includes journal bearing means and a cam means to provide a pivoting razor system.

It is known in the art that a razor blade assembly comprising a guard member, one or more blades with or without a spacer, and a cap member held rigidly together as a cartridge may be permanently attached or releasably attached to a handle so that the razor edges are at a fixed angular attitude relative to the handle.

It is also well known in the art to provide such a razor blade assembly with journal bearing means and cam means on the bottom of the razor blade assembly to mate with a handle having journal means formed on arms which are pivotally movable toward and away from each other and to also have a cam follower means on the razor handle to exert a biasing force on the cam means of the razor blade assembly. U.S. Pat. No. 4,083,104, issued to Nissen and Perry, and U.S. Pat. No. 4,057,896, issued to Trotta, the disclosures of which are incorporated herein by reference, disclose such pivoting razor systems.

Prior art pivoting arm razor handles typically included inwardly facing journals for connection with the journal bearing means of the razor blade assembly. This outside-in coupling necessitated a larger head portion of a razor handle than may be preferred. In addition, pivoting arm razor handles could pivot during loading of a razor blade assembly unless a locking mechanism was incorporated in the razor handle so that the arms would not pivot in the open position. Prior art pivoting systems typically also included a pusher member or button actuating means located on the back of the razor head. The exposed pusher member could cause unwanted release of the cartridge if dropped or placed incorrectly.

SUMMARY OF THE INVENTION

Briefly stated and according to an aspect of this invention, problems associated with pivoting arm razor handles have been substantially overcome by providing the razor handle of this invention. The handle provides an inside-out coupling of a mating razor blade assembly by having movable members slidably movable toward and away from each other. The handle also includes cam follower means for biasing the cam surface or surfaces of the mating razor blade assembly and means for maintaining or latching the movable members in a position toward each other until a portion of the cam follower means receives a predetermined force from the razor blade assembly.

It is an object of this invention to provide a safe, reliable, easy-to-manufacture razor handle with a limited number of uncomplicated parts to provide a narrow head razor handle.

It is also an object of this invention to provide an improved razor handle for a pivoting razor blade assembly.

BRIEF DESCRIPTION OF THE DRAWINGS

The invention both as to its organization and principles of operation, together with further objects and advantages thereof, may be better understood by referring to the following detailed description of an embodiment of the invention taken in conjunction with the accompanying drawings in which.

DESCRIPTION OF THE PREFERRED EMBODIMENT

Figure 1:
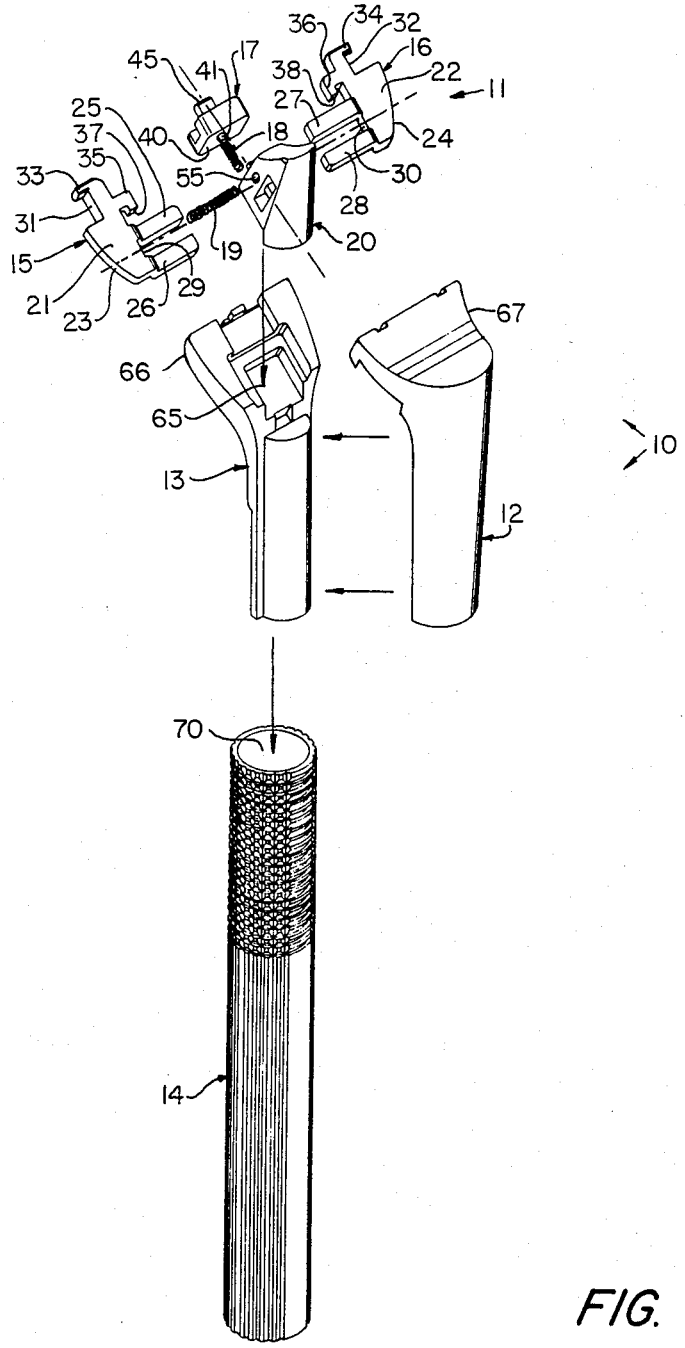
FIG. 1 is an exploded view illustrating an exemplary embodiment of the razor handle, in accordance with this invention.

Referring to FIG. 1, there is shown an exploded view of a razor handle assembly 10 comprising a six-piece subassembly 11, an external housing means comprising a back housing member 12, and a front housing member 13, and a gripping member 14.

The six-piece subassembly 11 includes first movable member 15, second movable member 16, a cam follower member 17, cam follower spring 18, movable member spring 19, and internal housing member 20.

First movable member 15 and second movable member 16 are identical in construction and preferably made of brass. Movable members 15 and 16 are respectively made up of main bodies 21, 22 having gripping surfaces 23, 24 on one side thereof and offset parallel fingers 25, 26, and 27, 28. The fingers 25, 26 of first movable member 15 are offset in a parallel plane below the main body 21 of the first movable member 15. Likewise, the second movable member 16, which is flipped over in orientation from the first member 15, illustrates fingers 27, 28 offset in a parallel plane above the main body 24 of second movable member 16. For the practice of this invention, the first movable member 15 could be formed with fingers 25, 26 offset in a plane above main body 21 and the second movable member 16 could be formed with fingers 27, 28 offset in a plane below main body 24. Offset surfaces 29 and 30 between the fingers of the movable members 15, 16 provide an abutting surface for the ends of movable member spring 19.

An upper portion of the movable members 15, 16 includes respective outer surfaces 31, 32 which act as stops in cooperation with the external housing means. On respective top portions of the movable members 15, 16 outwardly facing journals 33 and 34 are formed to cooperate with inwardly facing journal bearing means of an associated razor blade assembly to accomplish inside-out loading of the razor blade assembly. Extending from the inside of the top portion of the movable members 15, 16 are respective inwardly directed inverted L-shaped hook members 35, 36 with surfaces 37, 38.

Figure 3:
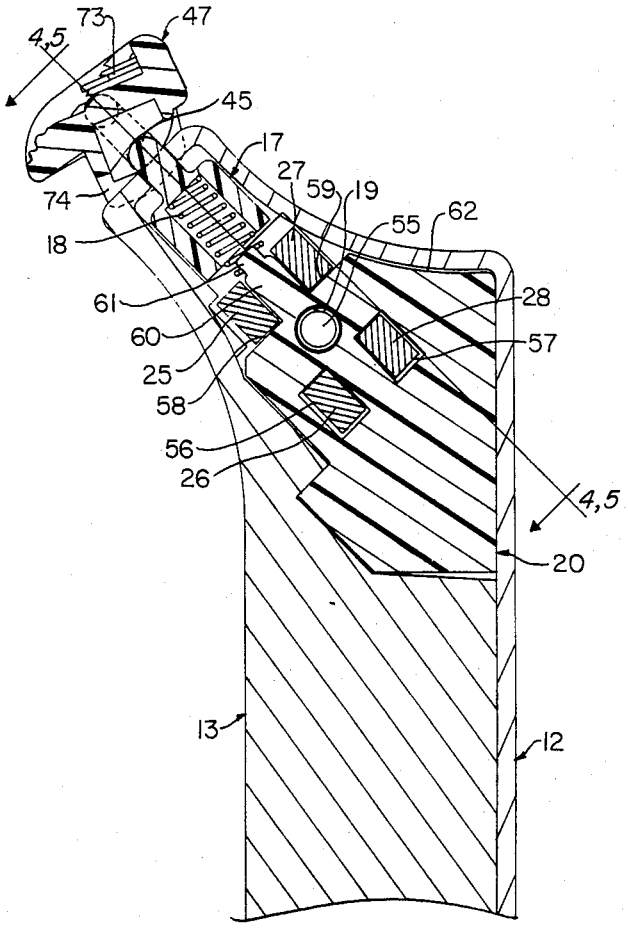
FIG. 3 is a center-line, cross-sectional view of the razor handle of FIG. 2, in accordance with this invention.
Figure 4:
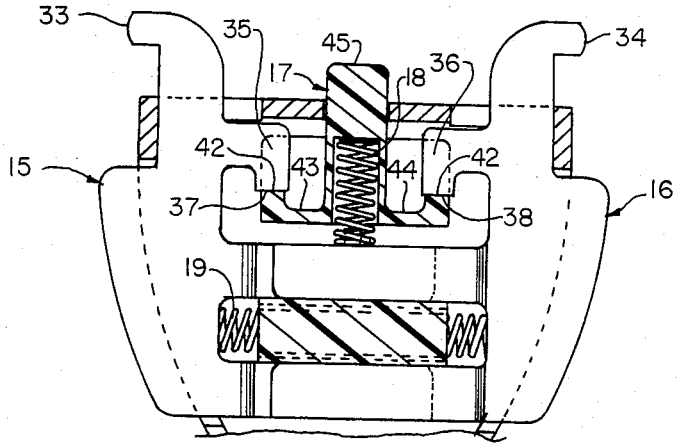
FIG. 4 is a sectional view taken along line 4, 5 of FIG. 3, showing the razor handle in its open or unlatched position and without the razor blade assembly, in accordance with this invention.
Figure 5:
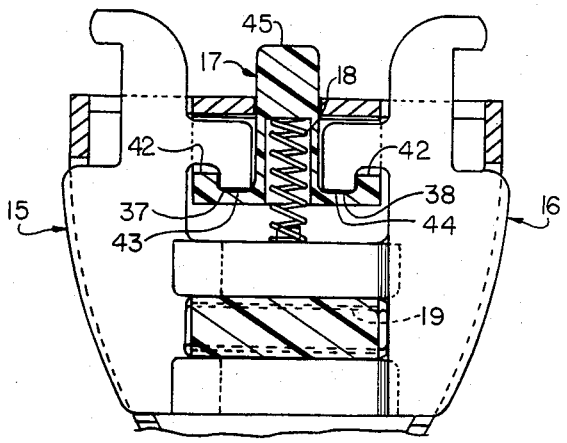
FIG. 5 is a sectional view taken along line 4, 5 of FIG. 3, showing the razor handle in its closed or latched position, in accordance with this invention.

Referring now to the cam follower member 17 as shown most fully in FIGS. 1, 3, 4, and 5, the cam follower member 17 is preferably a one-piece integrally molded member formed of a strong acetal resin. The cam follower member 17 has a bottom face 40 which includes an aperture 41 which receives and provides a stop for an end of cam follower spring 18. As best seen in FIGS. 4 and 5, an upper surface 42 of the cam follower member 17 includes recesses or catches 43 and 44. In operation, the surfaces 37, 38 of hook members 35 and 36 ride on the upper surface 42 of the cam follower member 17 when movable members 15 and 16 are in a position away from each other, as shown in FIG. 4. Surfaces 37 and 38 of hook members 35 and 36 fall into the recess or respective catches 43, 44 when movable members 15 and 16 are in a position toward each other as shown in FIG. 5.

Figure 7:
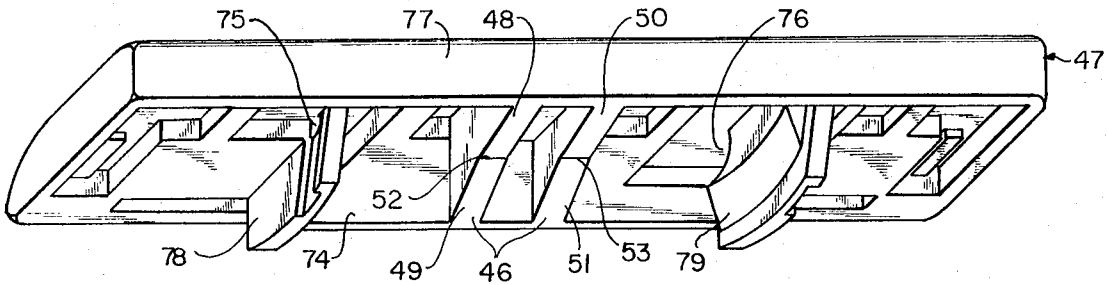
FIG. 7 is a bottom view of a razor blade assembly suitable for mating with the razor handle, in accordance with this invention.

Referring to FIGS. 1 and 7, cam follower member 17 also includes a free end 45 which, in a manner well known in the art, cooperates with cam means, such as cam means 46 of razor blade assembly 47. The cam means 46 located on the bottom surface of razor blade assembly 47 may include one or more oppositely inclined surfaces, such as surfaces 48 and 49 and surfaces 50 and 51, which respectively intersect to form a dihedral angle with an apex 52 and 53. It is within the confines of this invention to have a plurality of different types of cam means on the associated razor blade assembly, and cam means 46 may take the form of two separate cams as shown in FIG. 7 or a single cam member.

Referring to FIGS. 1 and 3, the internal housing member 20, which is also formed on an acetal resin, includes a pathway or hole 55 through which the movable member spring 19 is disposed. As best seen in FIG. 3, internal housing member 20 also includes squared-off holes 56 and 57. Squared-off holes 56 and 57, which are parallel, each receive one of the respective fingers 26, 28 of the movable members to provide a pathway for the slidable motion of the movable members as well as to aid in alignment of the movable members. Internal housing member 20 also includes top surface portions 58 and 59 for receiving fingers 25 and 27 of the movable members 15 and 16. Between top surface portion 58 and 59 of internal housing member 20 is a protruding member 60 having a bump portion 61 on its free end for mounting an end of the cam follower spring 18. A rear surface 62 of the internal housing member 20 is contoured to match the aesthetics of back housing member 12.

Cam follower spring 18 and movable member spring 19 are preferably formed of a stainless steel which is properly tempered and passivated. 302 stainless steel is an appropriate choice for forming the springs 18 and 19.

Referring to FIGS. 1, 3, 4, and 5, during assembly of the six-piece subassembly, the cam follower spring 18 is disposed between the cam follower member 17 and the internal housing member 20 by having a forward end positioned into the aperture 41 of the cam follower member 17 and having the other end of the cam follower spring 18 disposed over the bump portion 61 of internal housing member 20. The movable member spring 19 is disposed through the hole 55 of the internal housing member 20 and its ends are biased against offset surfaces 29 and 30 of respective movable members 15 and 16 to push the movable members 15 and 16 to a position away from each other, such as shown in FIG. 4. Finger 26 of the movable member 15 is inserted in the hole 56 of internal housing member 20, and finger 25 of the first movable member 15 is slidably disposed on top surface portion 58 of internal housing member 20 next to protruding member 60. Likewise, finger 28 of second movable member 16 is disposed in hole 57 of internal housing member 20, and finger 27 is disposed in sliding engagement on the top surface portion 59 of internal housing member 20 next to protruding member 60.

The formed six-piece subassembly 11 is then dropped into a mating chamber 65 formed between the insides of head portion 66 of the front housing member 13 and head portion 67 of the back housing member 12. The back housing member 12 is preferably made of 0.030 inch thick brass, and the front housing member 13 is preferably made of high-impact polystyrene.

The six-piece subassembly 11 may either be first dropped into the inside of head portion 67 of back housing member 12 and then have the front housing member 13 coupled thereto to form the mating chamber 65 or the six-piece subassembly 11 may first be dropped into the inside of head portion 66 of front housing member 13 and then have the back housing member 12 attached thereto.

Figure 6:
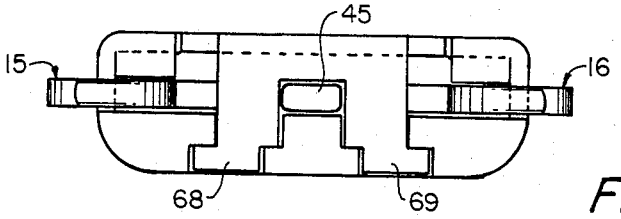
FIG. 6 is a top view of the head of the razor handle of FIG. 2, in accordance with this invention.

Referring to FIG. 6, the front and back housing members 12 and 13 are assembled by having extended finger member 68 and 69 of the head portion 67 of the back housing member 12 hooked or inserted into mating grooves or slots formed in the head portion 66 of the front housing member 13 and rotating the back housing member 12 down to achieve a fit.

Figure 2:
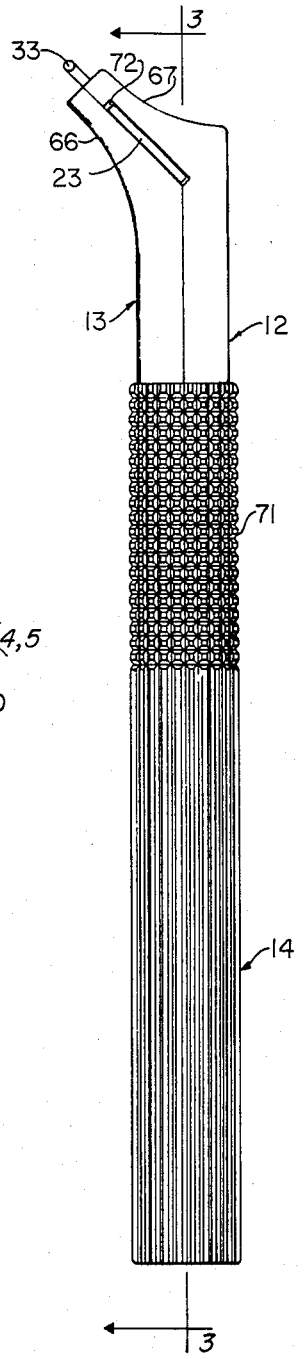
FIG. 2 is a side view of the razor handle of FIG. 1, in accordance with this invention.

Referring to FIG. 2, the gripping member 14 is illustrated to include at its upward end a knurled decorative portion 71. Disposed in the opening 70 at the top of the gripping member 14 is the lower extremity of the exterior housing means of the head of the razor handle which is attached, such as by a press fit into opening 70 on the top of the generally cylindrical aluminum gripping member 14. A slot 72 is formed by the mating back housing member 12 and front housing member 13 through which is disposed a portion of the main body and gripping surfaces, such as gripping surface 23 of the movable members.

Referring to FIG. 3, the razor handle is illustrated in its operative position coupled to razor blade assembly 47. The razor blade assembly 47 includes a blade means 73 comprising one or more blades with or without a spacer. The razor blade assembly 47 also has an extended forward skirt portion 74 also seen in FIG. 7. Referring specifically to FIG. 7, the cam surfaces 48 and 49, as well as cam surfaces 50 and 51, of razor blade assembly 47 are inclined at a predetermined angle relative to the plane of the platform underside of the razor blade assembly 47 so that the cam means 46 normally engages the free end 45 of cam follower member 17 substantially at the apexes 52 and 53 to cooperatively urge the blade means 73 in the razor blade assembly 47 to be in a plane at a desired angular attitude relative to the razor longitudinal axis for comfortable and efficient shaving. As the safety razor is moved along a skin surface, skin contours and convolutions act on the razor blade assembly 47 to generate a torque-producing force which pivotally moves the razor blade assembly 47 causing the free end 45 of the cam follower member 17 to move along the cam surfaces.

Referring to FIG. 4, the head portion of the razor handle is shown without the razor blade assembly thereon. If the razor blade assembly was coupled through journals 33 and 34, the cam means of the razor blade assembly would force the free end 45 of the cam follower member 17 to overcome the biasing force of the cam follower spring 18, and accordingly, the upper surface 42 of the cam follower member 17 would not be abutting the surfaces 37 and 38 of hook members 35 and 36.

FIG. 5 illustrates the head portion of the razor handle in its latched position in which the hook members 35 and 36 of the movable members 15 and 16 are held, or latched, in a closed position by the catches 43 and 44 of the cam follower member. The movable member spring 19 is compressed inward due to the gripping force applied by the fingers of the user of the razor handle.

Referring now to FIG. 7, a razor blade assembly 47 is shown which includes cam means 46 and journal bearing means 75 and 76. The forward skirt portion 74 also acts as a forward stop for the pivoting razor blade assembly 47 as well as defining a wall, which in conjunction with a back portion 77 of the cap portion of the razor blade assembly 47 and extended portions 78 and 79 through which the journal bearing means 75 and 76 are formed, provides a trap which aids in the alignment and orientation of the journals 33 and 34 into the journal bearing means 75 and 76. Other forms of stops or alignment means are also within the view of this invention.

In operation, the outwardly facing journals 33 and 34 are compressed in a sliding motion by the user applying a force to the gripping surfaces 23 and 24 of the first and second movable members 15 and 16 to overcome the biasing force of the movable member spring 19 to cause the hook members 35 and 36 to latch into the catches 43 and 44 of the cam follower member 17. The journals 33 and 34 are then oriented inside the journal bearing means 75 and 76 until the free end 45 of the cam follower member 17 receives a sufficient force from the cam means 46 of the razor blade assembly 47 to depress the cam follower member 17 and allow the release of the hook members 35 and 36 of the first and second movable members 15 and 16 thereby latching the razor blade assembly 47 to the razor handle assembly 10.

Disassembly of the razor blade assembly 47 from the razor handle assembly 10 requires the user to again press inward the gripping surfaces 23 and 24 of the first and second movable members 15 and 16 in order for the journal members 33 and 34 to slide toward each other and out of the mating journal bearing means 75 and 76 of the razor blade assembly 47. During operation of the assembled safety razor, the cam follower 17 acts independently of the rest of the razor assembly so that when the razor blade assembly 47 is pivoting, the cam follower is moving in and out through an opening in the exterior housing and the rest of the assembly does not interreact with this mechanism until unloading or decoupling is required.

While an embodiment and application of this invention has been shown and described, it will be apparent to those skilled in the art that many more modifications are possible without departing from the inventive concepts herein described. The invention, therefore, is not to be restricted except as is necessary by the prior art and by the spirit of the appended claims.

What is claimed as new and desired to be secured by Letters Patent of the United States is:

1. A razor handle for a razor blade assembly adapted to be movably mounted on said handle, the razor blade assembly having a cam means thereon for receiving a biasing force and journal bearing means for coupling to said handle, said razor handle comprising:

journal means disposed on first and second movable members of said razor handle, said first and second movable members each including a hook member, said movable members being slidably movable toward and away from each other to permit engagement of the journal bearing means of the razor with said journal means of said razor handle when said movable members are in a first position away from each other, and disengagement of the journal bearing means of the razor blade assembly with said journal means of said handle when said movable members are in a second position toward each other; and cam follower means having a free end portion, disposed between said first and second movable members and coupled to said razor handle for providing a yieldable biasing force on the cam means of the razor blade assembly, said cam follower means also including first and second catch means for releasably engaging said first and second hook members of said first and second movable members and for maintaining said movable members in said second position toward each other until said free end portion of said cam follower means receives a predetermined force from the razor blade assembly thereby releasing said movable members to said first position for engagement with the razor blade assembly.

2. The razor handle as in claim 1 further including a spring member, said spring member being disposed between said first and second movable members to provide a biasing force between said first and second movable members.

3. The razor handle as in claim 2 further including a housing means for housing said movable members and said cam follower means, said housing means including an aperture for reciprocal movement of said free end portion of said cam follower means and including first and second slot means for providing a stop to said movable members at said first position.

4. The razor handle as in claim 3 wherein said first movable member includes a first gripping portion and said second movable member includes a second gripping portion, said first and second gripping portions being disposed through said first and second slot means respectively.

5. The razor handle as in claim 4 wherein said journal means includes a first journal on said first movable member and a second journal on said second movable member, each of said journals having an outwardly directed free end.

6. The razor handle as in claim 5 wherein said first movable member is substantially identical to said second movable member.

7. A razor handle for a razor blade assembly adapted to be movably mounted on said handle, the razor blade assembly having a cam means thereon for receiving a biasing force and journal bearing means for coupling to said handle, said razor handle comprising:

first and second movable members coupled to said razor handle, each of said movable members including a gripping portion, an outwardly directed journal, an inwardly directed hook portion, and an alignment means, said first and second movable members being slidably movable toward and away from each other to permit engagement of said journal bearing means of the razor blade assembly with said outwardly directed journals of said movable members when said movable members are in a first position away from each other, and disengagement of the journal bearing means of the razor blade assembly with said outwardly directed journals of said movable members when said movable members are in a second position toward each other;

cam follower means having a free end portion coupled to said razor handle for providing a yieldable biasing force on the cam means of the razor blade assembly and for maintaining said movable members in said second position toward each other until said free end portion of said cam follower means receives a predetermined force from the razor blade assembly, thereby releasing said movable members to said first position for engagement with the razor blade assembly, said cam follower means including catches for releasably engaging said hook portions of said first and second movable members when maintaining said movable members in said second position;

an internal housing member having recesses for receiving said alignment means of said first and second movable members and further including a forward surface against which said cam follower means is biased; and an external housing member for receiving said internal housing and including first and second slot means for providing a pathway and a stop for said first and second movable members whereby said gripping portions of said movable members are disposed through said first and second slot means respectively, said external housing further including an aperture for providing a pathway for reciprocal movement of said free end portion of said cam follower means.

8. A razor handle as in claim 7 further including a spring wherein said internal housing member includes a passageway for said spring, said spring providing a biasing force to said first and second movable members.

9. The razor handle as in claim 8 further including an elongated gripping portion attached to said external housing.

10. The razor handle as in claim 9 wherein said external housing comprises a top and a bottom plate.

11. The razor handle as in claim 10 wherein the razor blade assembly also includes an extended skirt portion on the bottom of the razor blade assembly for guiding said journal means of said razor handle into said journal bearing means of the razor blade assembly.

* * * * *